US009742095B2

(12) United States Patent
Tsai et al.

(10) Patent No.: US 9,742,095 B2
(45) Date of Patent: Aug. 22, 2017

(54) ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Long-Fei Chen, New Taipei (TW); Dong Xiang, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/228,326

(22) Filed: Aug. 4, 2016

(65) Prior Publication Data

US 2017/0040721 A1 Feb. 9, 2017

(30) Foreign Application Priority Data

Aug. 6, 2015 (CN) ..... 2015 1 0476359

(51) Int. Cl.

| | |
|---|---|
| ***H01R 13/502*** | (2006.01) |
| ***H01R 12/70*** | (2011.01) |
| ***H01R 13/6594*** | (2011.01) |
| *H01R 12/72* | (2011.01) |
| *H01R 43/20* | (2006.01) |

(52) U.S. Cl.

CPC ..... *H01R 13/502* (2013.01); *H01R 12/707* (2013.01); *H01R 13/6594* (2013.01); *H01R 12/724* (2013.01); *H01R 43/205* (2013.01)

(58) Field of Classification Search

CPC ..... H01R 13/6587; H01R 13/6594; H01R 13/6581; H01R 13/6593; H01R 23/02

USPC ..... 439/660, 607.4, 607.55

See application file for complete search history.

(56) References Cited

U.S. PATENT DOCUMENTS

| | | | | |
|---|---|---|---|---|
| 9,312,641 | B2 * | 4/2016 | Wang | H01R 13/6585 |
| 2011/0312200 | A1 * | 12/2011 | Wang | H01R 12/724 439/218 |
| 2014/0194005 | A1 * | 7/2014 | Little | H01R 13/6585 439/607.28 |
| 2014/0206233 | A1 * | 7/2014 | Kao | H01R 13/6471 439/607.28 |
| 2015/0111433 | A1 * | 4/2015 | Hou | H01R 12/707 439/626 |
| 2015/0200504 | A1 * | 7/2015 | Little | H01R 24/60 439/345 |
| 2015/0229077 | A1 * | 8/2015 | Little | H01R 13/6582 439/78 |

* cited by examiner

*Primary Examiner* — Tulsidas C Patel
*Assistant Examiner* — Marcus Harcum

(57) ABSTRACT

An electrical receptacle connector includes a first insulated member and a second insulated member that are received in a metallic shell. First receptacle terminals are second receptacle terminals are respectively held in the first insulated member and the second insulated member. The first receptacle terminals include first tail portions, the second receptacle terminals include second tail portions, and the first tail portions and the second tail portions are aligned with each other by an offset. Therefore, the soldering condition between the second tail portions and contacts of a circuit board can be checked.

23 Claims, 15 Drawing Sheets

ELECTRICAL RECEPTACLE CONNECTOR

CROSS-REFERENCES TO RELATED APPLICATIONS

This non-provisional application claims priority under 35 U.S.C. §119(a) on Patent Application No. 201510476359.0 filed in China, P.R.C. on Aug. 6, 2015 the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical receptacle connector includes a plastic core, upper and lower receptacle terminals held on the plastic core, and an outer iron shell circularly enclosing the plastic core. A rear cover plate is extending from the outer iron shell to be at the rear of the entire Type-C connector and to cover the rear of the plastic core. The rear cover plate is for shielding the electromagnetic waves generated by the receptacle.

SUMMARY OF THE INVENTION

However, after the conventional USB type-C electrical connector is soldered on a circuit board, the legs of the receptacle terminals (for example, in SMT (surface Mount Technology) types), are approximately located at a bottom of the middle portion of the plastic core and soldered with the circuit board. Therefore, the contact regions between the legs and contacts of the circuit board cannot be checked. As a result, when soldering spots are not applied to the legs and the contacts of the circuit board properly, for example, if legs and the contacts of the circuit board are not firmly in contact with each other, or if the soldering spots between the legs are merged together to cause short circuit, the operator has to remove the solders and redo the soldering procedure. Therefore, how to solve the aforementioned problem is an issue.

In view of this, an embodiment of the instant disclosure provides an electrical receptacle connector. The electrical receptacle connector comprises a metallic shell, a first terminal module, and a second terminal module. The metallic shell comprises a shell body and a receptacle cavity formed in the shell body. The first terminal module is received in the receptacle cavity. The first terminal module comprises a first insulated member and a plurality of first receptacle terminals. The first insulated member comprises a first assembling portion and a plurality of observing windows. The first assembling portion is located at a bottom of a rear of the first insulated member. The first receptacle terminals are held at the first insulated member, and the first receptacle terminals comprise a plurality first tail portions extending from the rear of the first insulated member and located on the first assembling portion. The observing windows are formed on the bottom of the rear of the first insulated member and near to two sides of the first tail portions, respectively. The second terminal module is received in the receptacle cavity and combined with the first terminal module. The second terminal module comprises a second insulated member and a plurality of second receptacle terminals. The second insulated member comprises a second assembling portion. The second assembling portion is located at a bottom of a rear of the second insulated member and aligned in front of the first assembling portion. The second receptacle terminals are held at the second insulated member, and the second receptacle terminals comprise a plurality of second tail portions extending from the rear of the second insulated member and located on the second assembling portion. The second tail portions are aligned with the first tail portions by an offset. Positions of the second tail portions correspond to positions of the observing windows.

In one embodiment, a width of a hollowed region of each of the observing windows is greater than a width of each of the second tail portions.

In one embodiment, the electrical receptacle connector further comprises a circuit board, a first gap, and a second gap. The circuit board comprises a plurality of contacts. The first tail portions and the second tail portions are SMT legs and in contact with the contacts, respectively. The first gap is formed between a bottom surface of the rear of the first insulated member and a surface of the circuit board, and a height of the first gap is greater than a height from a bottom surface to a top surface of each of the first tail portions. The second gap is formed between a bottom surface of the rear of the second insulated member and the surface of the circuit board, and a height of the second gap is greater than a height form a bottom surface to a top surface of each of the second tail portions.

In one embodiment, the first terminal module further comprises a rear block extending outward from the rear of the first insulated member and covering the second tail portions, and the first assembling portion is formed on a bottom of the rear block.

In one embodiment, the first terminal module further comprises a through hole formed through the rear block and corresponding to the second tail portions.

In one embodiment, the metallic shell comprises a rear cover plate extending from a rear of the shell body. The rear cover plate comprises a baffle plate and hole formed on a surface of the baffle plate for seeing, along with the through hole, the second tail portions.

In one embodiment, each of the second receptacle terminals comprises a second body portion and a second bending portion. The second body portion is held in the second insulated member, and each of the second bending portions is extending between the corresponding second body portion and the corresponding second tail portion.

In one embodiment, the first receptacle terminals are at an upper surface of the second insulated member, and the second receptacle terminals are at a lower surface of the second insulated member. The first receptacle terminals and the second receptacle terminals have 180 degree symmetrical design with respect to a central point of the receptacle cavity as the symmetrical center.

Based on the above, the tail portions of the first receptacle terminals are aligned with the tail portions of the second receptacle terminals by an offset, so that the soldering condition between the tail portions of the second receptacle terminals and the contacts of the circuit board can be checked through the observing windows and the spaces between the tail portions of the first receptacle terminals. Accordingly, the soldering procedure can be redone instantly when soldering spots are not applied to the contacts and the tail portions of the second receptacle terminals properly, for example, if the tail portions of the second receptacle terminals and the contacts of the circuit board are not firmly in contact with each other, or if the soldering spots between the tail portions of the second receptacle terminals 41 are merged together to cause short circuit.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180 degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
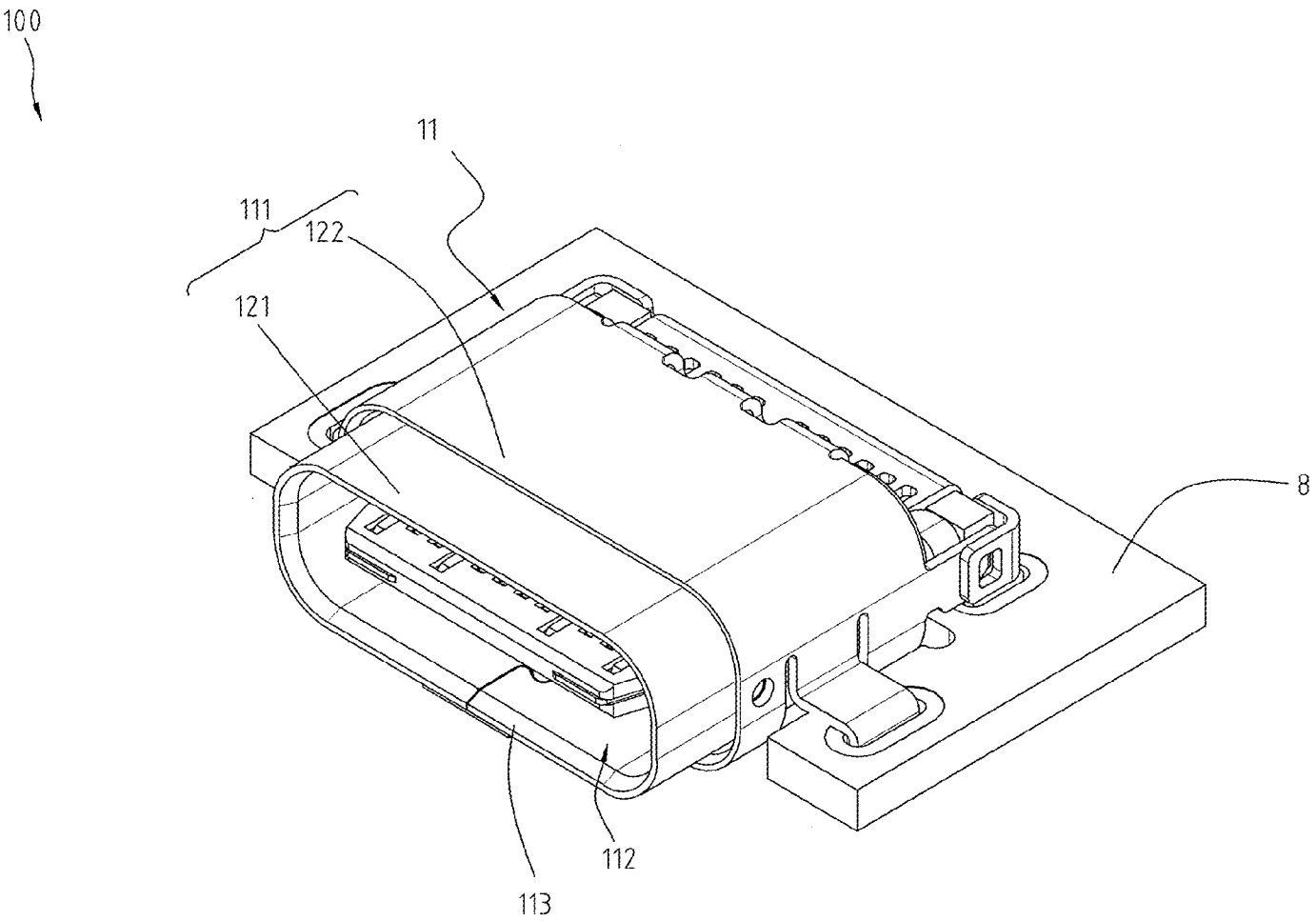
FIG. 1 illustrates a perspective view (1) of an electrical receptacle connector according to an exemplary embodiment of the instant disclosure.
Figure 2:
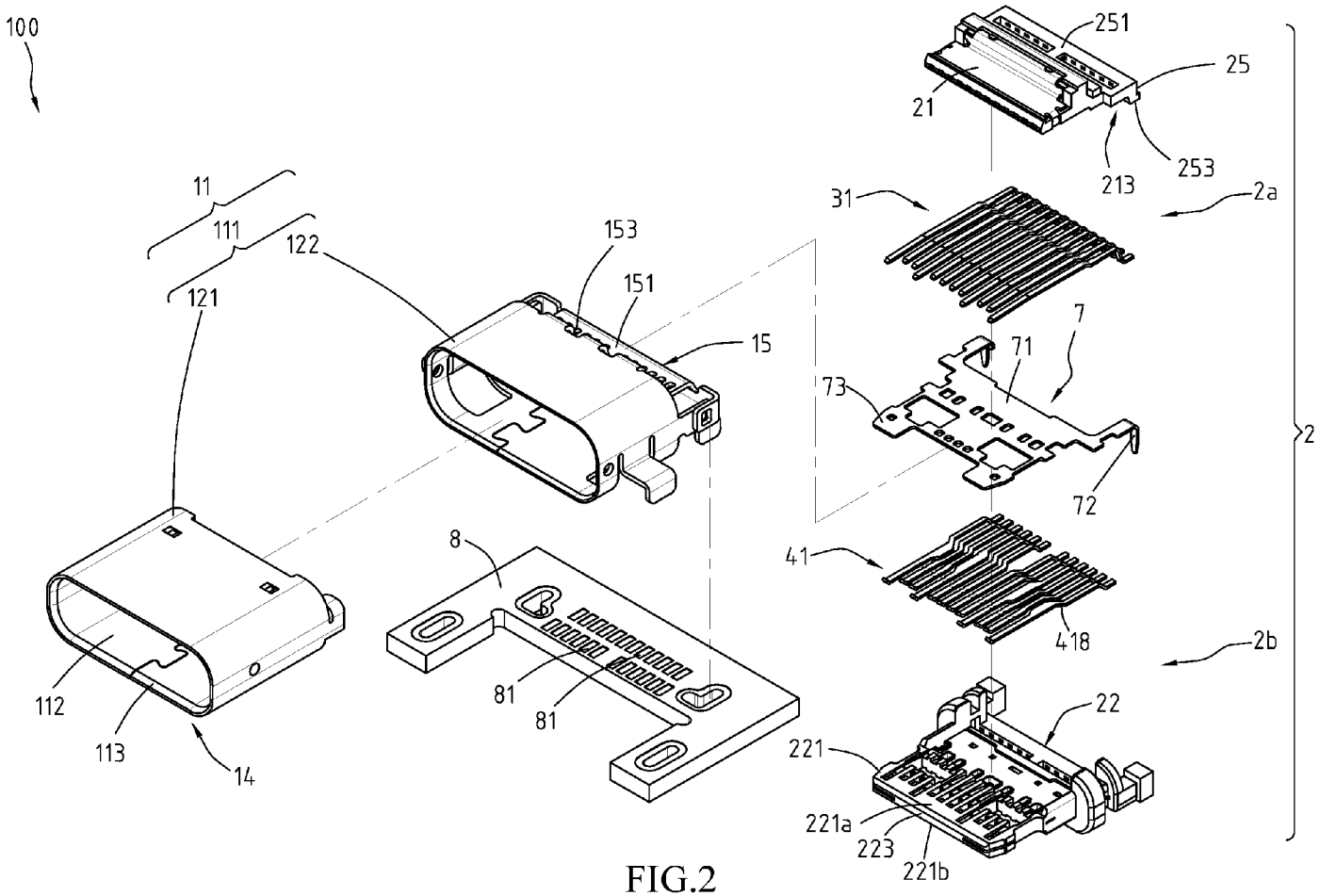
FIG. 2 illustrates an exploded view of the electrical receptacle connector.
Figure 3:
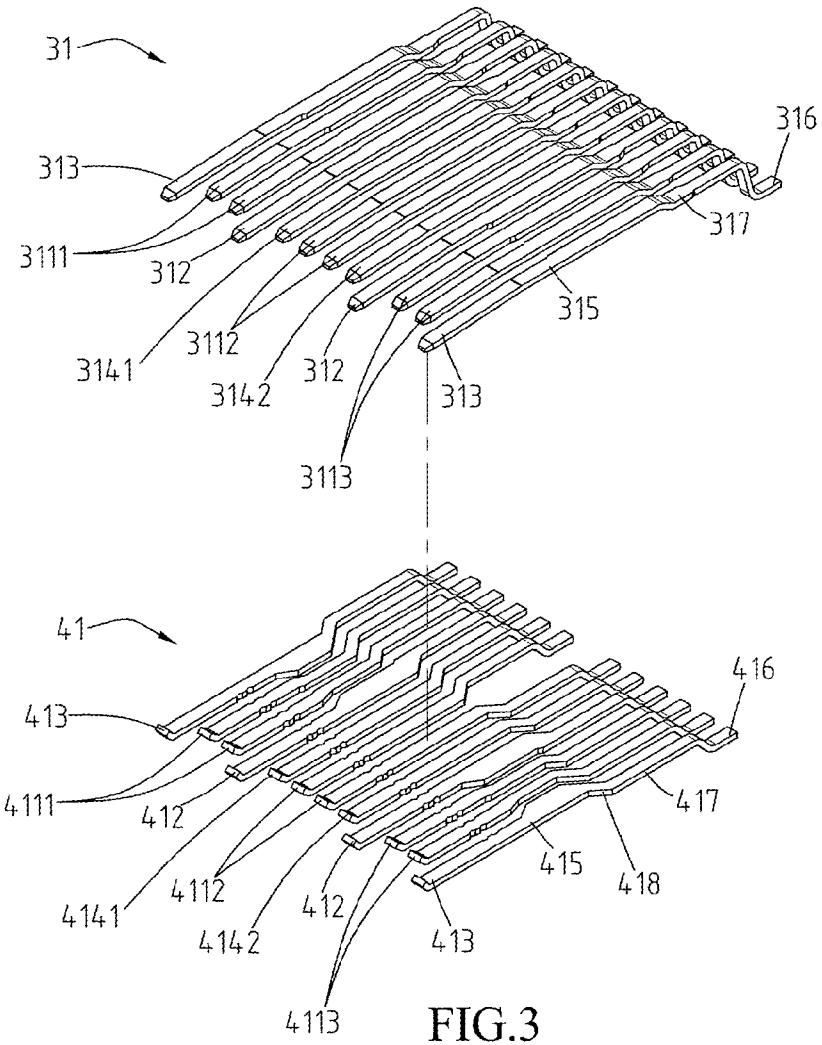
FIG. 3 illustrates a perspective view of first receptacle terminals and second receptacle terminals of the electrical receptacle connector.
Figure 4:
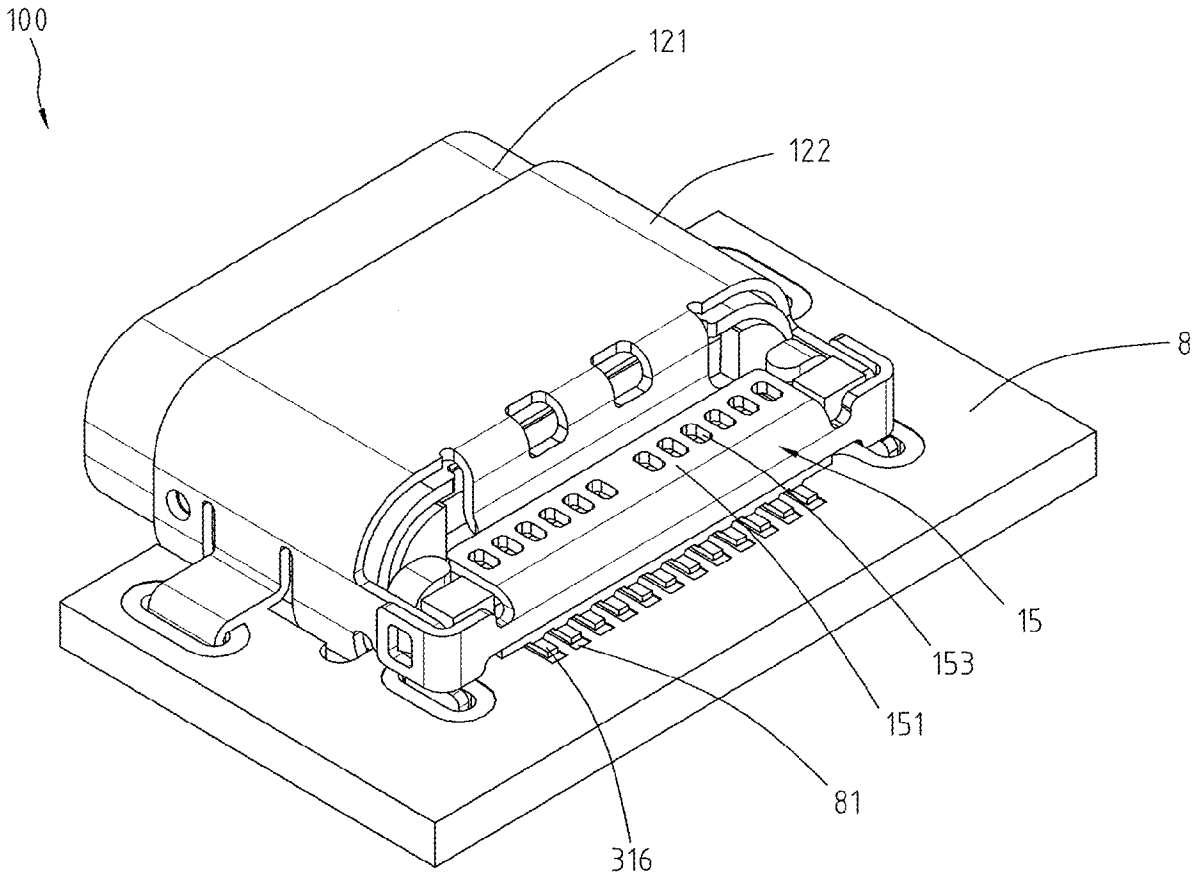
FIG. 4 illustrates a perspective view (2) of the electrical receptacle connector.

Please refer to FIGS. 1 to 4, which illustrate an electrical receptacle connector 100 of an exemplary embodiment of the instant disclosure. FIG. 1 illustrates a perspective view (1) of the electrical receptacle connector 100. FIG. 2 illustrates an exploded view of the electrical receptacle connector 100. FIG. 3 illustrates a perspective view of first receptacle terminals 31 and second receptacle terminals 41 of the electrical receptacle connector 100. FIG. 4 illustrates a perspective view (2) of the electrical receptacle connector. In this embodiment, the electrical receptacle connector 100 is assembled with a circuit board 8 by sinking technique. That is, one side of the circuit board 8 is cut to form a crack, and the electrical receptacle connector 100 is positioned at the crack and extending toward the side portion of the circuit board 8, but embodiments are not limited thereto. In some embodiments, the electrical receptacle connector 100 may be directly soldered on the surface of the circuit board 8. In other words, in such embodiment, the circuit board 8 does not have the crack for receiving the electrical receptacle connector 100, and the electrical receptacle connector 100 can be freely assembled on and electrically connected to any portion of the surface of the circuit board 8 without altering the structure of the components inside the connector. In this embodiment, the electrical receptacle connector 100 can provide a reversible or dual orientation USB Type-C connector interface and pin assignments, i.e., a USB Type-C receptacle connector. In this embodiment, the electrical receptacle connector 100 comprises a metallic shell 11, a first terminal module 2*a*, and a second terminal module 2*b*.

Figure 5:
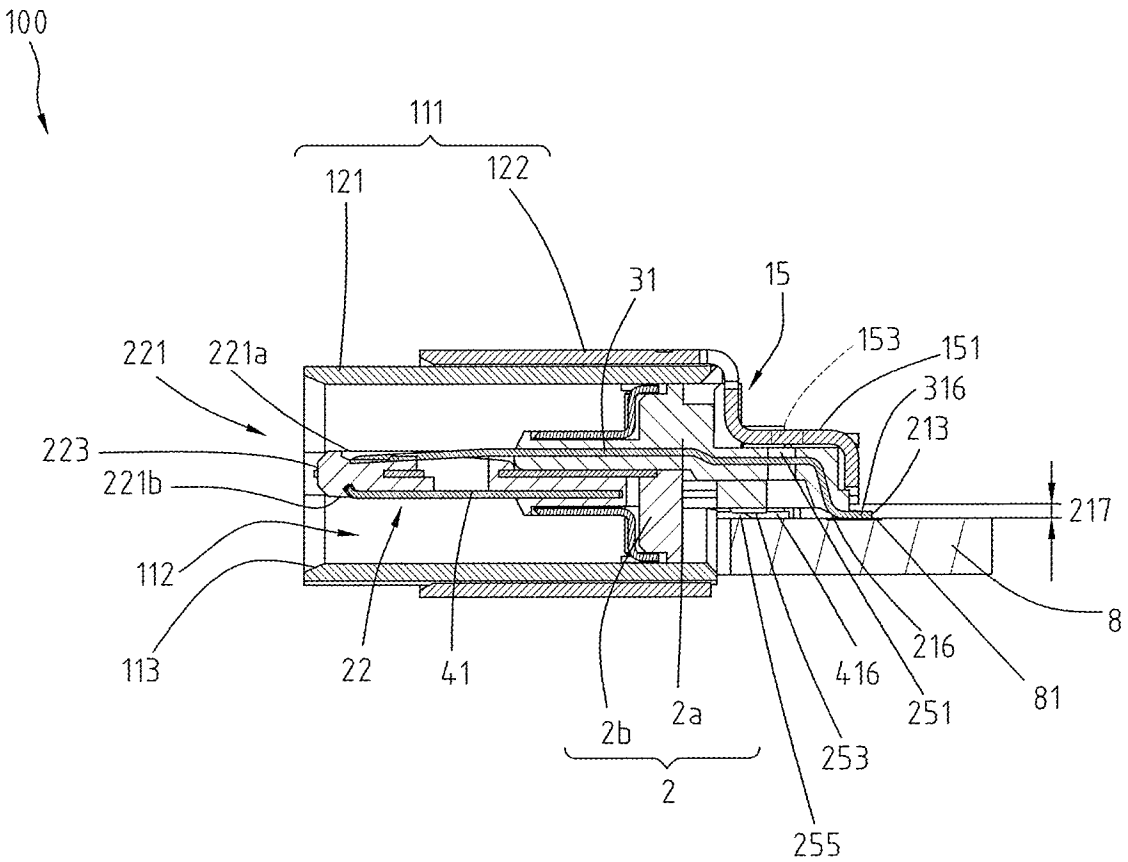
FIG. 5 illustrates a lateral sectional view of the electrical receptacle connector.

Please refer to FIGS. 1, 3, and 5. The metallic shell 11 is a hollowed shell, and the metallic shell 11 comprises a shell body 111 and a receptacle cavity 112 formed in the shell body 111. In this embodiment, the metallic shell 11 may be a tubular member 14 and the receptacle cavity 112 is formed in the tubular member 14. The metallic shell 11 may be formed by a multi-piece member; in such embodiment, the metallic shell 11 comprises an inner shell 121 and a cover shell 122, the inner shell 11 is a hollowed shell and encloses the first insulated member 21, and the cover shell 122 is a hollowed shell and encloses the inner shell 121, but embodiments are not limited thereto. In some embodiments, the cover shell 122 may be a semi-tubular member having a U-shape cross section, and the semi-tubular member covers the top and the two sides of the inner shell 121.

Please refer to FIGS. 4 and 5. The metallic shell 11 comprises a rear cover plate 15 extending from the rear of the shell body 111. The rear cover plate 15 comprises a baffle plate 151 and one or more holes 153 formed on the surface of the baffle plate 151. The number and the position of the hole 153 may correspond to or not correspond to the number and the position of the tail portions 416 (the holes shown in FIG. 9B correspond to the tail portions 416, while the holes shown in FIG. 9B correspond to the portions between the tail portions 416 rather than corresponding to the tail portions 416 directly). In addition, the width of the hole 153 may be less than, equal to, or greater than the width of the tail portion 416 (as shown in FIG. 9A, the width of the hole 153 is greater than the width of the tail portion 416). The tail portions 416 can be seen through the hole 153 and not shielded by the tail portions 316, and the soldering condition between the tail portions 416 of the second receptacle terminals 41 and the contacts 81 of the circuit board can be checked through the hole 153. Therefore, the soldering procedure can be redone when soldering spots are not applied to the contacts 81 and the tail portions 416 properly, for example, if the tail portions 416 of the second receptacle terminals 41 and the contacts 81 of the circuit board 8 are not firmly in contact with each other, or if the soldering spots between the tail portions 416 of the second receptacle terminals 41 are merged together to cause short circuit. The term "check" means, the soldering condition between the tail portions 416 as SMT (surface mount technology) legs and the contacts 81 of the circuit board 8 can be observed from the hole 153, so that an operator can determine if the soldering is sufficient or needs to be redone. In addition, the tail portions 416 are below the rear block 25. Therefore, once the rear cover plate 15 is devoid of the hole 153, the operator cannot check the soldering condition between the tail portions 416 and the contacts 81 of the circuit board 8 from any direction after the electrical receptacle connector 100 is assembled on the circuit board 8.

In this embodiment, the rear cover plate 15 is at the rear of the cover shell 122, but embodiments are not limited thereto. In some embodiments, the metallic shell 11 only comprises the inner shell 121 and does not comprise the cover shell 122, and the rear cover plate 15 may be at the rear of the inner shell 121 for diverse applications and reduced cost consumption. In addition, an insertion opening 113 with oblong shaped is formed on one side of the metallic shell 11, and the insertion opening 113 communicates with the receptacle cavity 112.

Please refer to FIGS. 2, 3, 5, 11, and 12A. The terminal seat 2 comprises a first terminal module 2*a* and a second terminal module 2*b*. In this embodiment, the first terminal module 2*a* is received in the receptacle cavity 112 of the metallic shell 11. The first terminal module 2*a* comprises a first insulated member 21 and a plurality of first receptacle terminals 31. The first insulated member 21 comprises a first assembling portion 213 and a plurality of observing windows 215. The first assembling portion 213 is located on the bottom of the rear of the first insulated member 21. The first receptacle terminals 31 are held in the first insulated member 21. The first receptacle terminals 31 comprise a plurality of tail portions 316 extending from the rear of the first insulated member 21 and located on the first assembling portion 213. The observing windows 215 are formed on the bottom of the rear of the first insulated member 21 and near to two sides of the tail portions 316. Specifically, in one embodiment, each of the observing windows 215 is defined by the sides of two neighboring tail portions 316 and a bottom surface 216 of the first insulated member 21, i.e., each of the observing windows 215 is reverse U-shaped.

Please refer to FIGS. 2 and 5. In this embodiment, the first terminal module 2*a* further comprises a rear block 25 and two through holes 251. The rear block 25 is extending outward from the rear of the first insulated member 21. In this embodiment, the first assembling portion 213 is formed on the bottom of the rear block 25, and the rear block 25 covers the rear of the tail portions 416. In addition, the two through holes 251 are formed through a middle portion of the rear block 25 along a transversal direction. The through holes 251 correspond to the tail portions 416, so that the soldering condition between the tail portions 416 and the circuit board 8 can be checked through the through holes 251. In this embodiment, the number of the through holes 251 is two, but embodiments are not limited thereto. In some embodiments, the number of the through holes 251 may be one or may be three or more.

Figure 13:
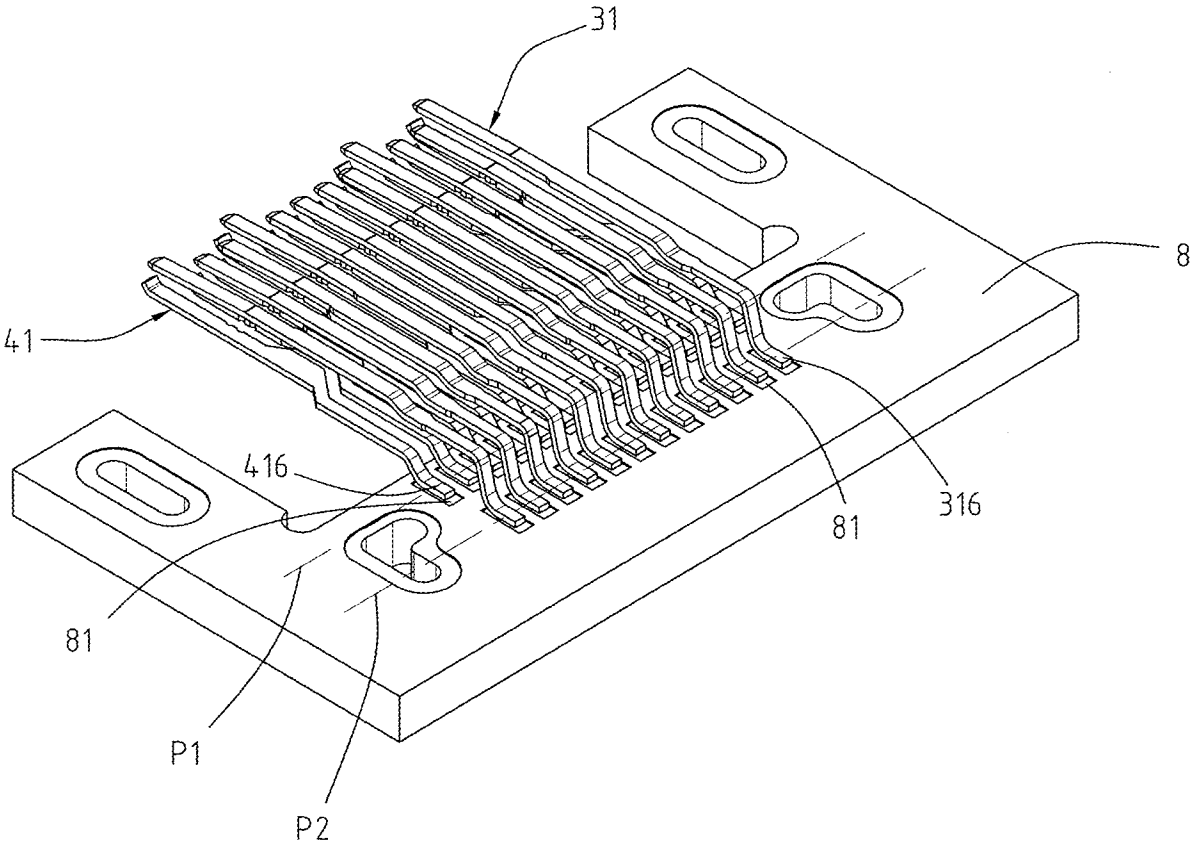
FIG. 13 illustrates a perspective view showing that the first receptacle terminals and the second receptacle terminals are assembled on the circuit board of the electrical receptacle connector.
Figure 14:
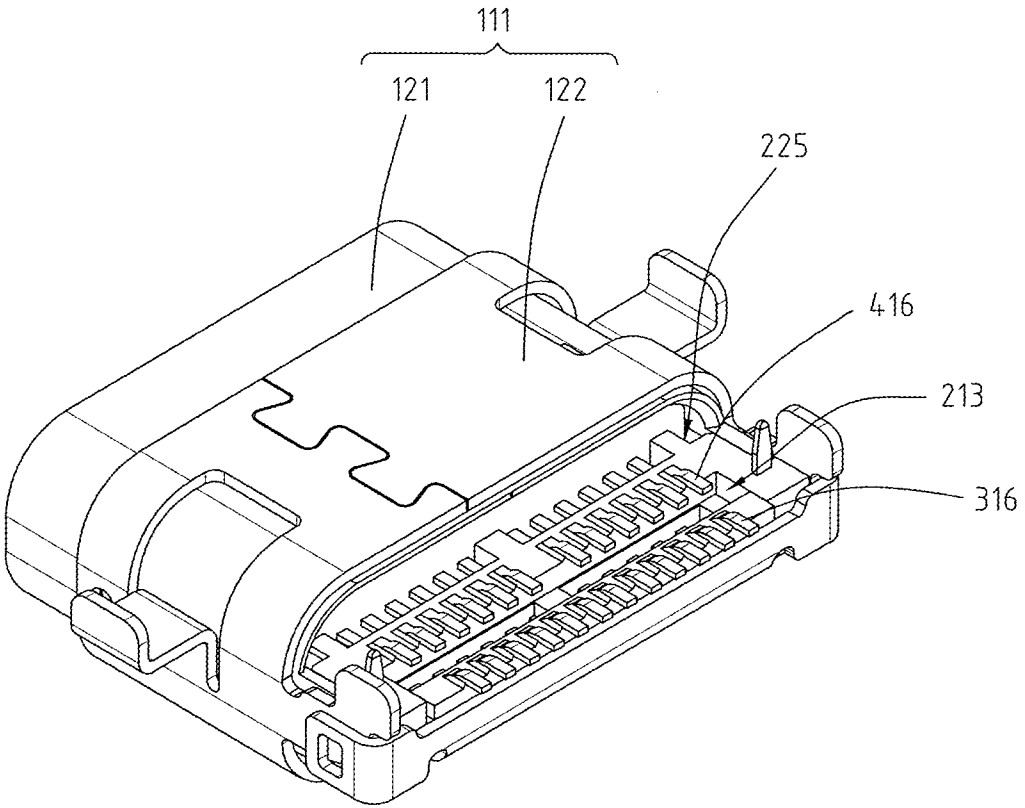
FIG. 14 illustrates a perspective view (3) of the electrical receptacle connector.

Please refer to FIGS. 2, 5, and 13. The second terminal module 2*b* is received in the receptacle cavity 112 of the metallic shell 11. The second terminal module 2*b* is combined with the first terminal module 2*a*. The second terminal module 2*b* comprises a second insulated member 22 and a plurality of second receptacle terminals 41. The second insulated member 22 comprises a second assembling portion 225 (as shown in FIG. 14). The second assembling portion 225 is located on the bottom of the rear of the second insulated member 22. The second assembling portion 225 is in front of and near to the first assembling portion 213. As viewed from the bottom of the electrical receptacle connector 100, the second assembling portion 225 is at a front row P1, while the first assembling portion 213 is at a rear row P2. The second receptacle terminals 41 are held in the second insulated member 22. The second receptacle terminals 41 comprise a plurality of tail portions 416 extending from the rear of the second insulated member 22 and located on the second assembling portion 225. In addition, the tail portions 416 are aligned with the tail portions 316 by an offset.

Figure 9:
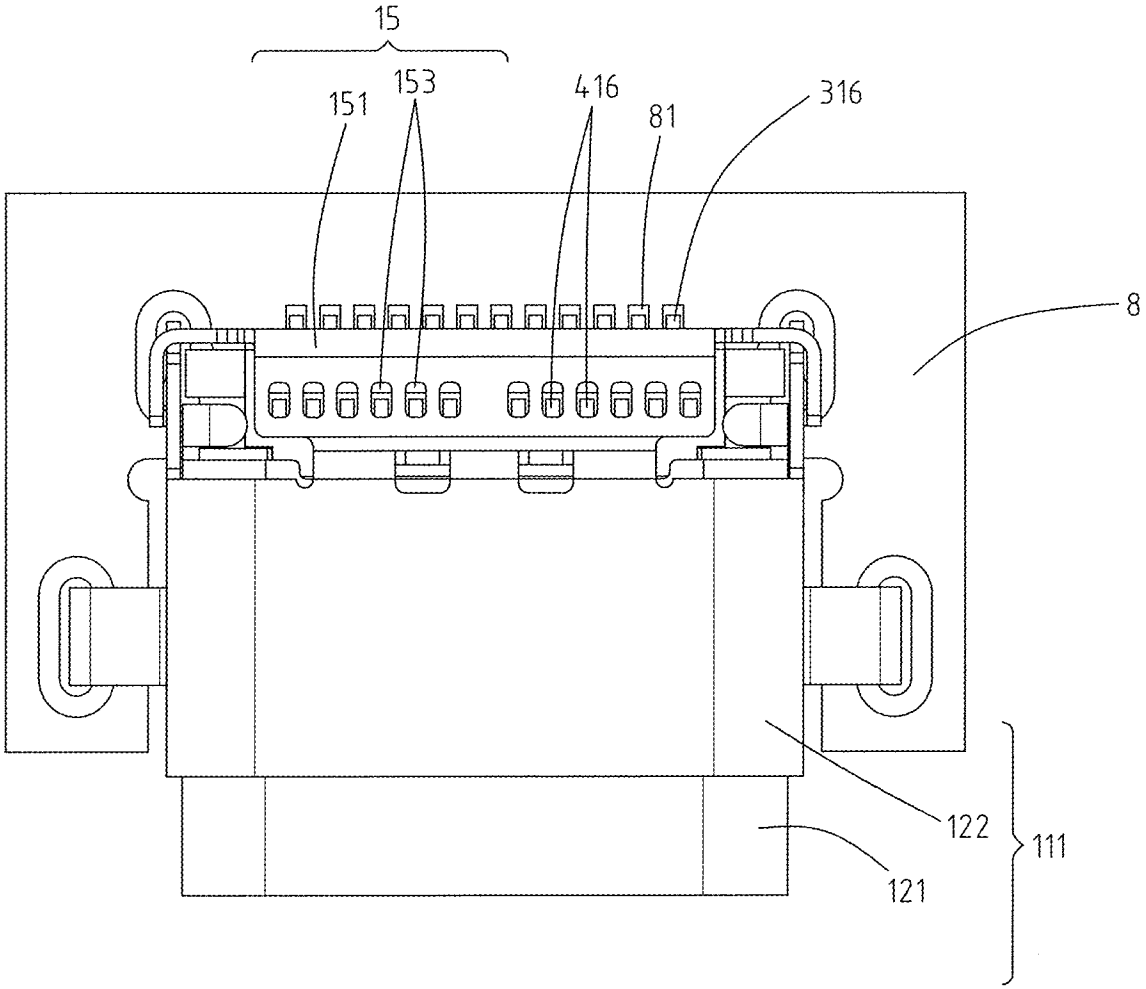
FIG. 9 illustrates a top view of the electrical receptacle connector.
Figure 9A:
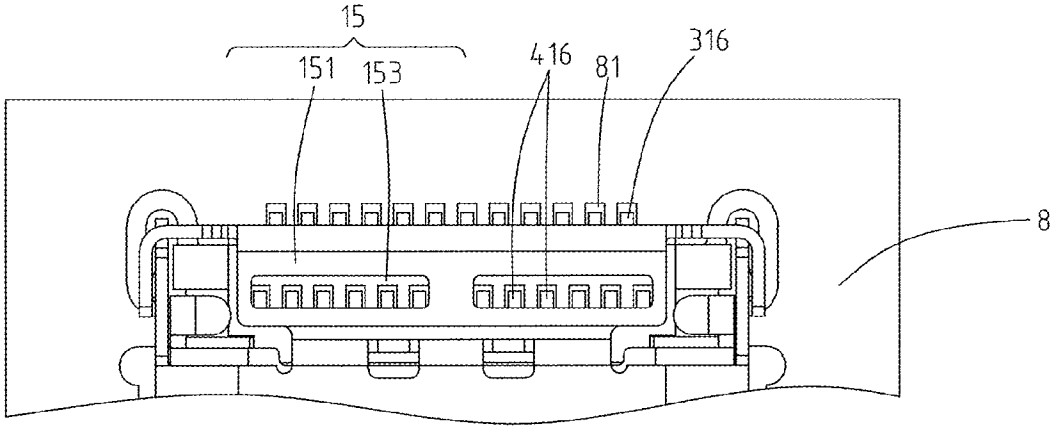
FIG. 9A illustrates a top view of the electrical receptacle connector with different numbers of holes.
Figure 9B:
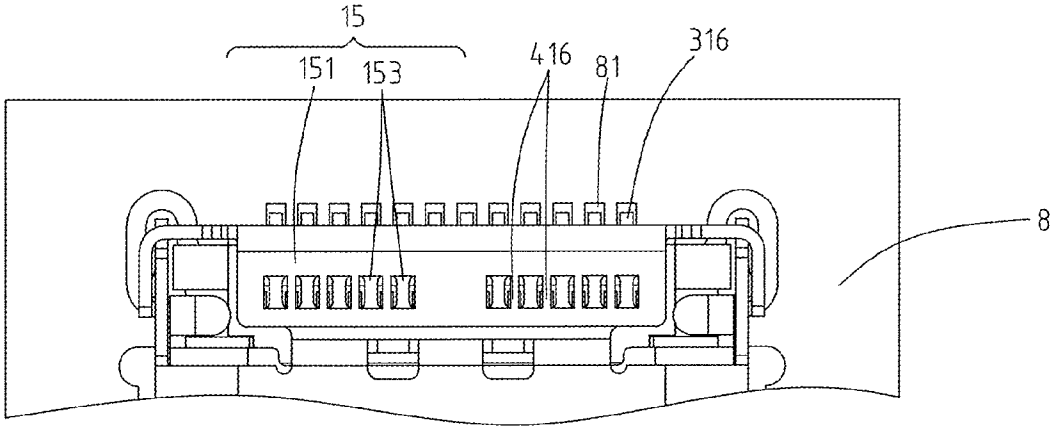
FIG. 9B illustrates a top view of the electrical receptacle connector with another different numbers of holes.
Figure 10:
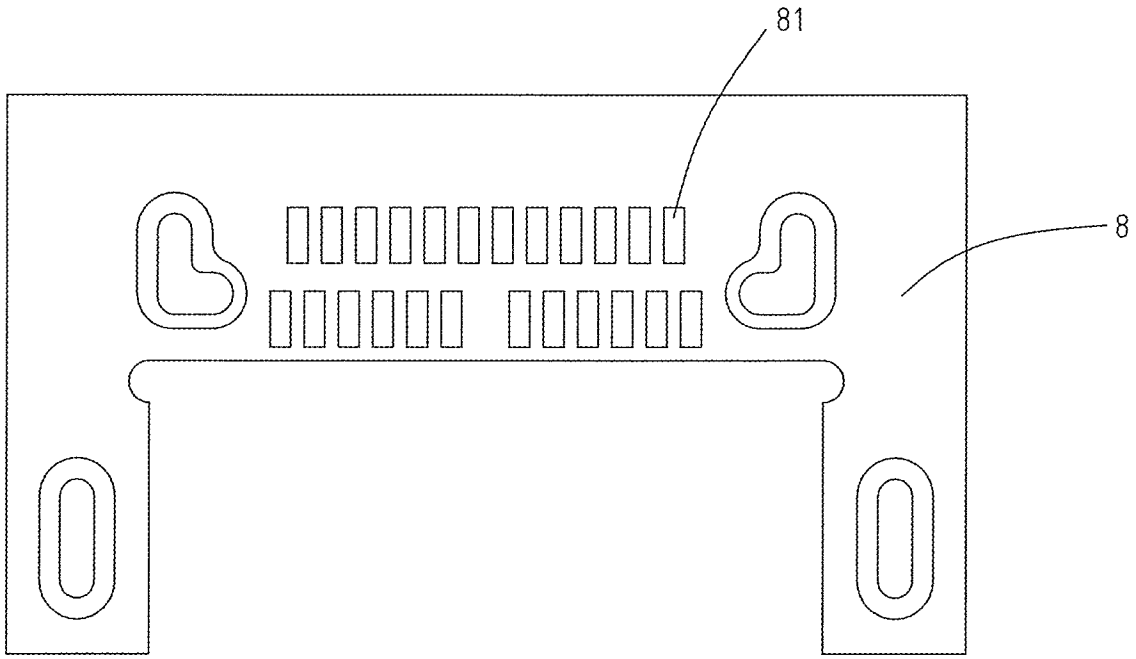
FIG. 10 illustrates a top view of a circuit board of the electrical receptacle connector.
Figure 11:
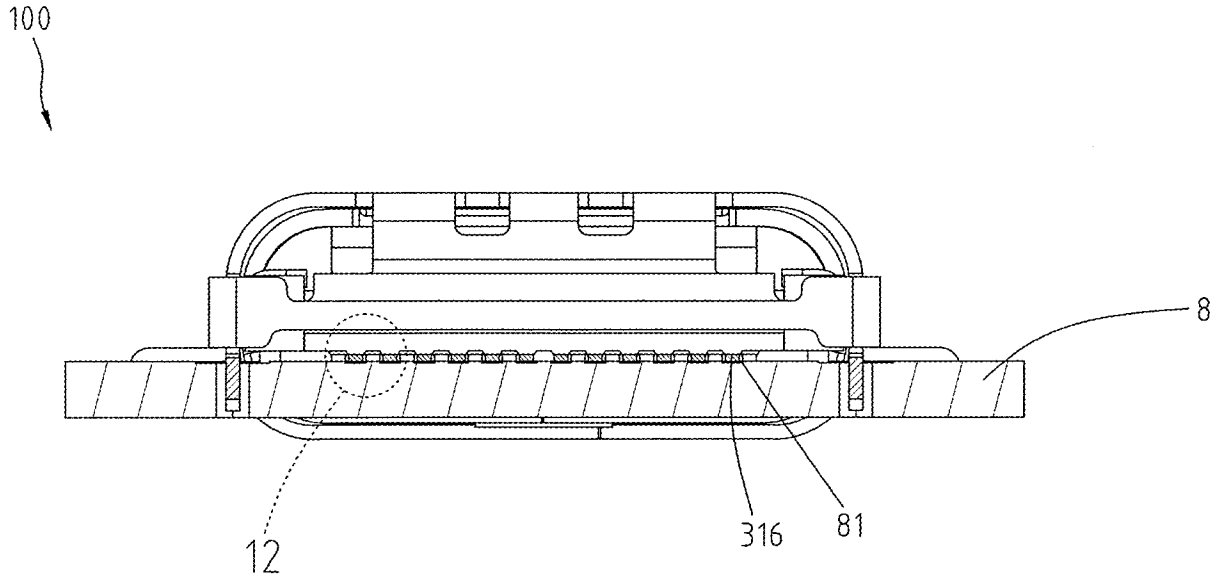
FIG. 11 illustrates a rear elevational view of the electrical receptacle connector.
Figures 12A, 12B, 12C:
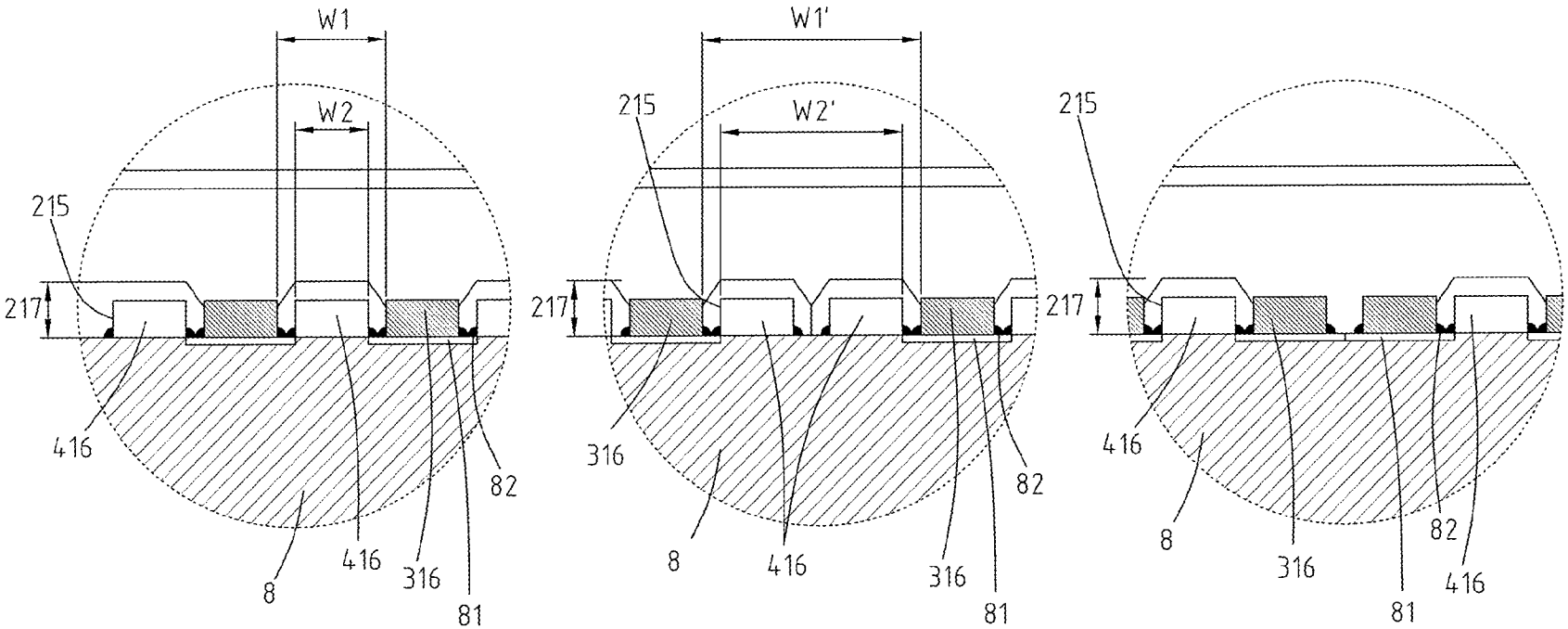
FIG. 12A illustrates an enlarged view of the portion 12 of FIG. 11 in which tail portions of the receptacle terminals are aligned by a first embodiment.
FIG. 12B illustrates an enlarged view of the portion 12 of FIG. 11 in which the tail portions of the receptacle terminals are aligned by a second embodiment.
FIG. 12C illustrates an enlarged view of the portion 12 of FIG. 11 in which the tail portions of the receptacle terminals are aligned by a third embodiment.

The term "by an offset" means that each of the tail portion 316 and the corresponding tail portion 416 are not aligned along the same line (as shown in FIG. 9). Furthermore, because of the offset alignment, when viewing from the rear of the electrical receptacle connector 100 toward the tail portions 316, 416 (as shown in FIGS. 11 and 12A), the tail portions 416 can be seen through the spaces between the tail portions 316. In other words, the positions of the tail portions 416 correspond to the positions of the observing windows 215, and the observing windows 215 correspond to the spaces between the tail portions 316. Therefore, the soldering condition between the tail portions 416 and the contacts 81 of the circuit board can be checked through the observing windows 215 between the tail portions 316. As a result, the soldering procedure can be redone when soldering spots are not applied to the contacts 81 and the tail portions 416 properly, for example, if the tail portions 416 and the contacts 81 of the circuit board 8 are not firmly in contact with each other, or if the soldering spots between the tail portions 416 are merged together to cause short circuit. The term "check" means, the soldering condition between the tail portions 416 as SMT legs and the contacts 81 of the circuit board 8 can be observed from the observing windows 215, so that an operator can determine if the soldering is sufficient or needs to be redo. In this embodiment, the width W1 of a hollowed portion of each of the observing windows 215 is greater than the width W2 of each of the tail portions 416.

Please refer to FIGS. 11, 12A, 13, and 14. In this embodiment, the tail portions 316 are aligned with the tail portions 416 by an offset. When the tail portions 316, 416 viewed from the rear of the electrical receptacle connector 100, a first one of the tail portions 316 is followed by, in order, a first one of the tail portions 416, a second one of the tail portions 316, a second one of the tail portions 416, and so forth, but embodiments are not limited thereto. In some embodiments, a first one of the tail portions 316 is followed by, in order, two or more tail portions 416, a second one of the tail portions 316, and so forth (as shown in FIG. 12B). In addition, in such embodiment, the width W1' of the hollowed portion of each of the observing windows 215 is greater than the overall width W2' of two or more tail portions 416. In a further option, a first one of the tail portions 416 is followed by, in order, two or more tail portions 316, a second one of the tail portions 416, and so forth (as shown in FIG. 12C). Accordingly, these configurations also allow the offset alignment between the tail portions 316, 416. Therefore, the soldering condition between the tail portions 416 as SMT legs and the contacts 81 of the circuit board 8 can be checked, and these configurations broaden the applications of the connector as well.

Figure 6:
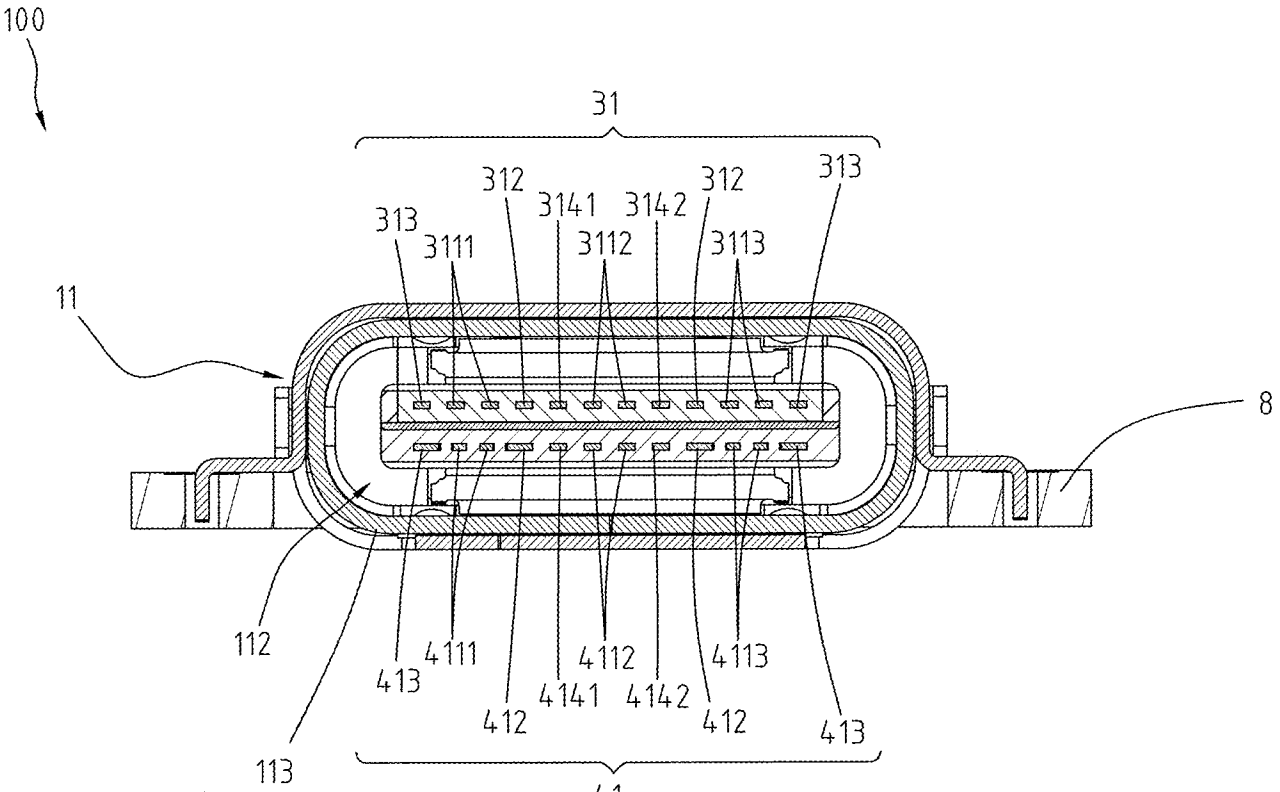
FIG. 6 illustrates a front sectional view of the electrical receptacle connector.

Please refer to FIGS. 2, 5, and 6. In this embodiment, the terminal seat 2 comprises a tongue portion 221 extending from one end of the second insulated member 22, but not from the first insulated member 21. Alternatively, two tongue portions may be respectively extending from the first insulated member 21 and the second insulated member 22, the two tongue portions are stacked with each other, and a grounding plate 7 is between the two tongue portions. In a further option, the tongue portion may be extending from one end of the first insulated member 21, but not from the second insulated member 22.

Please refer to FIGS. 2, 5, and 6. In this embodiment, the second insulated member 22 and the tongue portion 221 are manufactured by injection molding technique or the like, so that the second insulated member 22 and the tongue portion 221 are integrated with each other to form a one-piece member. In addition, the grounding plate 7 is in the second insulated member 22 and the tongue portion 221. In one embodiment, the first terminal module 2*a* and the second terminal module 2*b* are combined with each other by assembling, but embodiments are not limited thereto. In some embodiments, the first terminal module 2*a* and the second terminal module 2*b* may be formed by injection molding or the like for being adapted to different needs. In addition, the tongue portion 221 has two opposite surfaces, one is a first surface 221*a* (i.e., the upper surface), and the other is a second surface 221*b* (i.e., the lower surface). In addition, the front lateral surface 223 of the tongue portion 221 is connected the first surface 221*a* with the second surface 221*b* and is close to the insertion opening 113. In other words, the front lateral surface 223 is near to the insertion opening 113 and perpendicularly connected to the first surface 221*a* and the second surface 221*b*, respectively.

Please refer to FIGS. 2, 5, and 6. In this embodiment, the first receptacle terminals 31 and the first insulated member 21 are combined with each other by insert-molded techniques; likewise, the second receptacle terminals 41 and the second insulated member 22 are combined with each other by insert-molded techniques.

Figure 7:
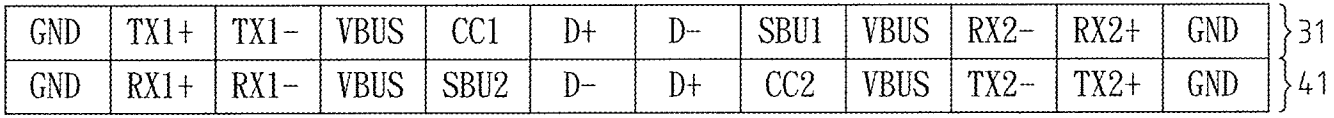
FIG. 7 illustrates a schematic configuration diagram of the receptacle terminals of the electrical receptacle connector shown in FIG. 6.

Please refer to FIGS. 2, 3, 5, and 7. The first receptacle terminals 31 comprise a plurality of first signal terminals 311, at least one power terminal 312, and at least one ground terminal 313. The first signal terminals 31 comprises a plurality of pairs of first high-speed signal terminals 3111/3113 and a pair of first low-speed signal terminals 3112. Referring to FIG. 7, the first receptacle terminals 31 comprise, from left to right, a ground terminal 313 (Gnd), a first pair of first high-speed signal terminals 3111 (TX1+−, differential signal terminals for high-speed signal transmission), a power terminal 312 (Power/VBUS), a first function detection terminal 3141 (CC1, a terminal for inserting orientation detection of the connector and for cable recognition), a pair of first low-speed signal terminals 3112 (D+−, differential signal terminals for low-speed signal transmission), a supplement terminal 3142 (SBU1, a terminal can be reserved for other purposes), another power terminal 312 (Power/VBUS), a second pair of first high-speed signal terminals 3113 (RX2+−, differential signal terminals for high-speed signal transmission), and another ground terminal 313 (Gnd). In this embodiment, twelve first receptacle terminals 31 are provided for transmitting USB 3.0 signals. Each pair of the first high-speed signal terminals 3111/3113 is between the corresponding power terminal 312 and the adjacent ground terminal 313. The pair of the first low-speed signal terminals 3112 is between the first function detection terminal 3141 and the supplement terminal 3142.

In some embodiments, the rightmost ground terminal 313 (Gnd) (or the leftmost ground terminal 313 (Gnd)) or the first supplement terminal 3142 (SBU1) can be further omitted. Therefore, the total number of the first receptacle terminals 31 can be reduced from twelve terminals to seven terminals. Furthermore, the ground terminal 313 (Gnd) may be replaced by a power terminal 312 (Power/VBUS) and provided for power transmission. In this embodiment, the width of the power terminal 312 (Power/VBUS) may be, but not limited to, equal to the width of the first signal terminal 311. In some embodiments, the width of the power terminal 312 (Power/VBUS) may be greater than the width of the first signal terminal 311 and an electrical receptacle connector 100 having the power terminal 312 (Power/VBUS) can be provided for large current transmission.

Please refer to FIGS. 2, 3, 5, and 7. The first receptacle terminals 31 are held in the first insulated member 21 and formed as the upper-row terminals of the electrical receptacle connector 100. Each of the first receptacle terminals 31 comprises a flat contact portion 315, a body portion 317, and a tail portion 316 (also called tail portion 316). For each of the first receptacle terminals 31, the body portion 317 is held in the first insulated member 21, the flat contact portion 315 is extending forward from the body portion 317 in the rear-to-front direction and partly exposed upon the first surface 221*a* of the tongue portion 221, and the tail portion 316 is extending backward from the body portion 317 in the front-to-rear direction and protruding from the rear of the first insulated member 21. The first signal terminals 311 are disposed at the first surface 221*a* and transmit first signals (namely, USB 3.0 signals). The tail portions 316 are bent horizontally to form flat legs, named SMT (surface mounted technology) legs, which can be mounted or soldered on the surface of a printed circuit board by using surface mount technology. In addition, the overall width of the tail portions 316 is equal to the overall width of the body portions 317. Therefore, the tail portion 316 and the body portion 317 of each of the first receptacle terminals 31 are aligned along the same line, and the distance between two adjacent tail portions 316 correspond the distance between two adjacent contacts 81 of the circuit board 8.

Please refer to FIGS. 2, 3, 5, and 7. The second receptacle terminals 41 comprise a plurality of second signal terminals 411, at least one power terminal 412, and at least one ground terminal 413. The second receptacle terminals 41 comprise a plurality of pairs of second high-speed signal terminals 4111/4113 and a pair of second low-speed signal terminals 4112. Referring to FIG. 7, the second receptacle terminals 41 comprise, from right to left, a ground terminal 413 (Gnd), a first pair of second high-speed signal terminals 4111 (TX2+−, differential signal terminals for high-speed signal transmission), a power terminal 412 (Power/VBUS), a second function detection terminal 4141 (CC2, a terminal for inserting orientation detection of the connector and for cable recognition), a pair of second low-speed signal terminals 4112 (D+−, differential signal terminals for low-speed signal transmission), a supplement terminal 4142 (SBU2, a terminal can be reserved for other purposes), another power terminals 412 (Power/VBUS), a second pair of second high-speed signal terminals 4113 (RX1+−, differential signal terminals for high-speed signal transmission), and another ground terminal 413 (Gnd). In this embodiment, twelve second receptacle terminals 41 are provided for transmitting USB 3.0 signals. Each pair of the second high-speed signal terminals 4111/4113 is between the corresponding power terminal 412 and the adjacent ground terminal 413. The pair of the second low-speed signal terminals 4112 is between the second function detection terminal 4141 and the supplement terminal 4142.

In some embodiments, the rightmost ground terminal 413 (or the leftmost ground terminal 413) or the second supplement terminal 4142 (SBU2) can be further omitted. Therefore, the total number of the second receptacle terminals 41 can be reduced from twelve terminals to seven terminals. Furthermore, the rightmost ground terminal 413 may be replaced by a power terminal 412 and provided for power transmission. In this embodiment, the width of the power terminal 412 (Power/VBUS) may be, but not limited to, equal to the width of the second signal terminal 411. In some embodiments, the width of the power terminal 412 (Power/VBUS) may be greater than the width of the second signal terminal 411 and an electrical receptacle connector 100 having the power terminal 412 (Power/VBUS) can be provided for large current transmission.

Please refer to FIGS. 2, 3, 5, and 7. The second receptacle terminals 41 are held in the second insulated member 11 and formed as the lower-row terminals of the electrical receptacle connector 100. In addition, the first receptacle terminals 31 are substantially aligned parallel with the second receptacle terminals 41. In this embodiment, each of the second receptacle terminals 41 comprises a flat contact portion 415, a body portion 417, and a tail portion 416 (also called second tail portion 416). For each of the second receptacle terminals 41, the body portion 417 is held in the second insulated member 22 and the tongue portion 221, the flat contact portion 415 is extending from the body portion 417 in the rear-to-front direction and partly exposed upon the second surface 221*b* of the tongue portion 221, and the tail portion 416 is extending backward from the body portion 417 in the front-to-rear direction and protruding from the rear of the second insulated member 22. The second signal terminals 411 are disposed at the second surface 221*b* and transmit second signals (i.e., USB 3.0 signals). The tail portions 416 are bent horizontally to form flat legs, named SMT (surface mounted technology) legs, which can be mounted or soldered on the surface of a printed circuit board by using surface mount technology.

Please refer to FIGS. 2, 3, 5, and 7. In this embodiment, the second receptacle terminals 41 further comprise a plurality of bending portions 418. Each of the bending portions 418 is extending between the corresponding tail portion 416 and the corresponding body portion 417, so that the tail portions 416 are aligned with the tail portions 316 by an offset, but embodiments are not limited thereto. In some embodiments, the first receptacle terminals 31 may comprise a plurality of bending portions, and the positions of the tail portions 316 may be adjusted by the bending portions of the first receptacle terminals 31. Accordingly, the tail portions 316 are aligned with the tail portions 416 by an offset. In this embodiment, the overall width of the tail portions 416 is greater than the overall width of the tail portions 316, and the tail portion 416 and the body portion 417 of each of the second receptacle terminals 41 are not aligned along the same line, and the distance between two adjacent tail portions 416 correspond the distance between two adjacent contacts 81 of the circuit board 8.

Please refer to FIGS. 5, 8, 13, and 14. Specifically, from a bottom view of the electrical receptacle connector 100, the tail portions 316 are aligned at the front row P1, i.e., the tail portions 416 are aligned at the rear row P2. The tail portions 416 are located on the bottom of the rear of the connector, while the tail portions 316 are located on the bottom of the middle portion of the connector. Moreover, the tail portions 316, 416 are protruded from the first insulated member 21 and the second insulated member 22 and arranged separately. The tail portions 316, 416 may be arranged into two parallel rows. Alternatively, the tail portions 416 may be aligned into two rows and the first row of the tail portions 416 is aligned by an offset with respect to the second row of the tail portions 416; thus, the tail portions 316, 416 form three rows.

Please refer to FIGS. 5, 8, 10, 12A and 13. The electrical receptacle connector 100 further comprises the circuit board 8. The circuit board 5 comprises a plurality of contacts 81 corresponding to the tail portions 316 and the tail portions 416. The tail portions 316 and the tail portions 416 are as SMT legs and in contact with the contacts 81. The electrical receptacle connector 100 further comprises a first gap 217 and a second gap 255. The first gap 217 is formed between the bottom surface of the rear of the first insulated member 21 and the surface of the circuit board 8. The height of the first gap 217 is greater than the height from the bottom surface to the top surface of each of the tail portions 316. The second gap 255 is formed between the bottom surface of the rear of the second insulated member 22 and the surface of the circuit board 8. The height of the second gap 255 is greater than the height from the bottom surface to the top surface of each of the tail portions 416.

Figure 8:
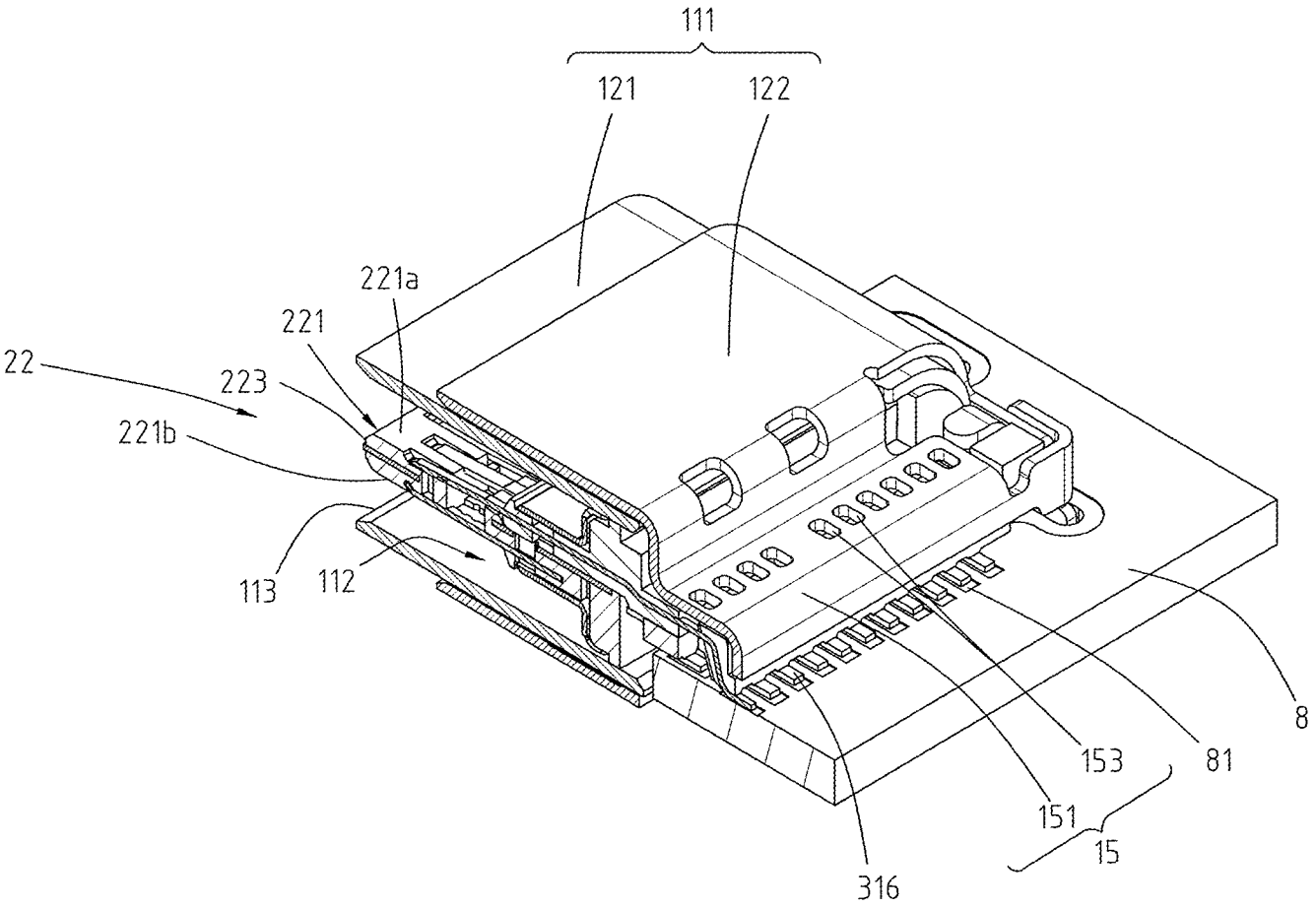
FIG. 8 illustrates a perspective exploded view of the electrical receptacle connector.

Please refer to FIGS. 2, 6, and 8. The electrical receptacle connector 100 further comprises a grounding plate 7. The grounding plate 7 is between the first terminal module 2*a* and the second terminal module 2*b*. The grounding plate 7 comprises a plate body 71 and a plurality of legs 72. The plate body 71 is between the first receptacle terminals 31 and the second receptacle terminals 41, i.e., the plate body 71 is held at the second insulated member 22, and the plate body 71 is between the flat contact portions 315 of the first receptacle terminals 31 and the flat contact portions 415 of the second receptacle terminals 41. The plate body 71 is assembled on the surface of the second insulated member 22. Specifically, the plate body 71 may be lengthened and widened, so that the front of the plate body 71 is near to the front lateral surface 223 of the tongue portion 221, two sides of the plate body 71 is near to two sides of the tongue portion 221, and the rear of the plate body 71 is near to the rear of the second insulated member 22. Accordingly, the plate body 71 can be disposed on the tongue portion 221 and the second insulated member 22, and the structural strength of the tongue portion 221 and the shielding performance of the tongue portion 221 can be improved.

In addition, the legs 72 are extending downward from two sides of the rear of plate body 71 to form vertical legs, i.e., DIP legs. That is, the legs 72 are exposed out of the second insulated member 22 and in contact with the circuit board 8. In this embodiment, the crosstalk interference can be reduced by the shielding of the grounding plate 7 when the flat contact portions 315, 415 transmit signals. Furthermore, the structural strength of the tongue portion 221 can be improved by the assembly of the grounding plate 7. In addition, the legs 72 of the grounding plate 7 are exposed from the second insulated member 22 and in contact with the circuit board 5 for conduction and grounding.

Please refer to FIG. 2, in which the grounding plate 7 further comprises a plurality of hooks 73. The plate body 71 is between the flat contact portions 315 of the first receptacle terminals 31 and the flat contact portions 415 of the second receptacle terminals 41. The hooks 73 are extending outward from two sides of the front of the plate body 71 and protruding out of the front lateral surface 223 and two sides of the tongue portion 221. When an electrical plug connector is mated with the electrical receptacle connector 100, elastic pieces at two sides of an insulated housing of the electrical plug connector are engaged with the hooks 73, and the elastic pieces would not wear against the tongue portion 221 of the electrical receptacle connector 100. Hence, the grounding plate 7 can be in contact with the metallic shell 11 for conduction and grounding.

Please refer to FIGS. 2 and 6 to 8. In this embodiment, pin-assignments of the first receptacle terminals 31 and the second receptacle terminals 41 are point-symmetrical with a central point of the receptacle cavity 112 as the symmetrical center. In other words, pin-assignments of the first receptacle terminals 31 and the second receptacle terminals 41 have 180 degree symmetrical design with respect to the central point of the receptacle cavity 112 as the symmetrical center. The dual or double orientation design enables an electrical plug connector to be inserted into the electrical receptacle connector 100 in either of two intuitive orientations, i.e., in either upside-up or upside-down directions. Here, point-symmetry means that after the first receptacle terminals 31 (or the second receptacle terminals 41), are rotated by 180 degrees with the symmetrical center as the rotating center, the first receptacle terminals 31 and the second receptacle terminals 41 are overlapped. That is, the rotated first receptacle terminals 31 are arranged at the position of the original second receptacle terminals 41, and the rotated second receptacle terminals 41 are arranged at the position of the original first receptacle terminals 31. In other words, the first receptacle terminals 31 and the second receptacle terminals 41 are arranged upside down, and the pin assignments of the flat contact portions 315 are left-right reversal with respect to that of the flat contact portions 415. An electrical plug connector is inserted into the electrical receptacle connector 100 with a first orientation where the first surface 221*a* is facing up, for transmitting first signals. Conversely, the electrical plug connector is inserted into the electrical receptacle connector 100 with a second orientation where the first surface 221*a* is facing down, for transmitting second signals. Furthermore, the specification for transmitting the first signals is conformed to the specification for transmitting the second signals. Note that, the inserting orientation of the electrical plug connector is not limited by the electrical receptacle connector 100 according embodiments of the instant disclosure.

Additionally, in some embodiments, the electrical receptacle connector 100 is devoid of the first receptacle terminals 31 (or the second receptacle terminals 41) when an electrical plug connector to be mated with the electrical receptacle connector 100 has upper and lower plug terminals. In the case that the first receptacle terminals 31 are omitted, the upper plug terminals or the lower plug terminals of the electrical plug connector are in contact with the second receptacle terminals 41 of the electrical receptacle connector 100 when the electrical plug connector is inserted into the electrical receptacle connector 100 with the dual orientations. Conversely, in the case that the second receptacle terminals 41 are omitted, the upper plug terminals or the lower plug terminals of the electrical plug connector are in contact with the first receptacle terminals 31 of the electrical receptacle connector 100 when the electrical plug connector is inserted into the electrical receptacle connector 100 with the dual orientations.

Please refer to FIGS. 2, 5, and 6. In this embodiment, as viewed from the front of the receptacle terminals 31, 41, the position of the first receptacle terminals 31 corresponds to the position of the second receptacle terminals 41. In other words, the positions of the flat contact portions 315 are respectively aligned with the positions of the flat contact portions 415, but embodiments are not limited thereto. In some embodiments, the first receptacle terminals 31 may be aligned by an offset with respect to the second receptacle terminals 41. That is, the flat contact portions 315 are aligned by an offset with respect to the flat contact portions 415. Accordingly, because of the offset alignment of the flat contact portions 315, 415, the crosstalk between the first receptacle terminals 31 and the second receptacle terminals 41 can be reduced during signal transmission. It is understood that, when the receptacle terminals 31, 41 of the electrical receptacle connector 100 have the offset alignment, plug terminals of an electrical plug connector to be mated with the electrical receptacle connector 100 would also have the offset alignment. Hence, the plug terminals of the electrical plug connector can be in contact with the receptacle terminals 31, 41 of the electrical receptacle connector 100 for power or signal transmission.

In the foregoing embodiments, the receptacle terminals 31, 41 are provided for transmitting USB 3.0 signals, but embodiments are not limited thereto. In some embodiments, for the first receptacle terminals 31 in accordance with transmission of USB 2.0 signals, the first pair of the first high-speed signal terminals 3111 (TX1+−) and the second pair of the first high-speed signal terminals 3113 (RX2+−) are omitted, and the pair of the first low-speed signal terminals 3112 (D+−) and the power terminals 312 (Power/VBUS) are retained. While for the second receptacle terminals 41 in accordance with transmission of USB 2.0 signals, the first pair of the second high-speed signal terminals 4111 (TX2+−) and the second pair of the second high-speed signal terminals 4113 (RX1+−) are omitted, and the pair of the second low-speed signal terminals 4112 (D+−) and the power terminals 412 (PowerNBUS) are retained.

In this embodiment, the electrical receptacle connector 100 further comprises a plurality of conductive sheets. The conductive sheets are metal elongated plates and may comprise an upper conductive sheet and a lower conductive sheet. The upper conductive sheet is assembled on the upper portion of the first insulated member 21, and the lower conductive sheet is assembled on the lower portion of the second insulated member 22. When an electrical plug connector is mated with the electrical receptacle connector 100, the front of a metallic shell of the electrical plug connector is in contact with the conductive sheets, the metallic shell of the electrical plug connector is efficiently in contact with the metallic shell 11 of the electrical receptacle connector 100 via the conductive sheets, and the electromagnetic interference (EMI) problem can be improved.

Based on the above, the tail portions of the first receptacle terminals are aligned with the tail portions of the second receptacle terminals by an offset, so that the soldering condition between the tail portions of the second receptacle terminals and the contacts of the circuit board can be checked through the observing windows and the spaces between the tail portions of the first receptacle terminals. Accordingly, the soldering procedure can be redone instantly when soldering spots are not applied to the contacts and the tail portions of the second receptacle terminals properly, for example, if the tail portions of the second receptacle terminals and the contacts of the circuit board are not firmly in contact with each other, or if the soldering spots between the tail portions of the second receptacle terminals 41 are merged together to cause short circuit.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180 degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metallic shell comprising a shell body and a receptacle cavity formed in the shell body;

a first terminal module, received in the receptacle cavity of the metallic shell, wherein the first terminal module comprises a first insulated member and a plurality of first receptacle terminals, wherein the first insulated member comprises a first assembling portion, the first assembling portion is located at a bottom of a rear of the first insulated member, the first receptacle terminals are held in the first insulated member and comprise a plurality of first tail portions extending out from the rear of the first insulated member and contacting the bottom surface of the first assembling portion, a plurality of recesses are formed in a bottom surface of the first assembling portion, each recess respectively extending between sides of two neighboring first tail portions, such that a plurality of observing windows are respectively defined by sides of two neighboring first tail portions and the corresponding recess extending there between; and a second terminal module, received in the receptacle cavity of the metallic shell and combined with the first terminal module, wherein the second terminal module comprises a second insulated member and a plurality of second receptacle terminals, wherein the second insulated member comprises a second assembling portion located at a bottom of a rear of the second insulated member and aligned in front of the first assembling portion, the second receptacle terminals are held in the second insulated member and comprise a plurality of second tail portions extending from the rear of the second insulated member and located on the second assembling portion, the second tail portions are aligned with the first tail portions by an offset, and positions of the second tail portions correspond to positions of the observing windows;

wherein the electrical receptacle connector is arranged to be assembled with a circuit board with the first tail portions and the second tail portions are respectively in contact with a plurality of contacts of the circuit board, and wherein a height of the observation windows measured from a surface of the circuit board is greater than a height from a bottom surface to a top surface of each of the first tail portions, and the second tail portions are visible through the observation windows when so assembled.

2. The electrical receptacle connector according to claim 1, wherein a width of a hollowed region of each of the observing windows is greater than a width of each of the second tail portions.

3. The electrical receptacle connector according to claim 1, wherein the first tail portions and the second tail portions are SMT legs.

4. The electrical receptacle connector according to claim 1, further comprising a first gap formed between the bottom of the rear of the first insulated member and a surface of the circuit board, wherein a height of the first gap is greater than a height from a bottom surface to a top surface of each of the first tail portions.

5. The electrical receptacle connector according to claim 1, further comprising a second gap formed between the bottom of the rear of the second insulated member and a surface of the circuit board, wherein a height of the second gap is greater than a height from a bottom surface to a top surface of each of the second tail portions.

6. The electrical receptacle connector according to claim 1, wherein the first terminal module further comprises a rear block extending outward from the rear of the first insulated member and covering the second tail portions, and wherein the first assembling portion is formed on a bottom of the rear block.

7. The electrical receptacle connector according to claim 6, wherein the first terminal module further comprises a through hole formed through the rear block and corresponding to the second tail portions.

8. The electrical receptacle connector according to claim 7, wherein the metallic shell comprises a rear cover plate extending from a rear of the shell body, wherein the rear cover plate comprises a baffle plate and a hole formed on a surface of the baffle plate for seeing, along with the through hole, the second tail portions.

9. The electrical receptacle connector according to claim 1, wherein each of the second receptacle terminals comprises a second body portion and a second bending portion, the second body portion is held in the second insulated member, and each of the second bending portions is extending between the corresponding second body portion and the corresponding second tail portion.

10. The electrical receptacle connector according to claim 1, wherein the first receptacle terminals are at an upper surface of the second insulated member, and the second receptacle terminals are at a lower surface of the second insulated member, and wherein the first receptacle terminals and the second receptacle terminals have 180 degree symmetrical design with respect to a central point of the receptacle cavity as the symmetrical center.

11. The electrical receptacle connector according to claim 1, wherein the first terminal module and the second terminal module together constitute a one-piece member.

12. The electrical receptacle connector according to claim 11, further comprising a grounding plate, wherein the grounding plate comprises a plate body is between the first receptacle terminals and the second receptacle terminals.

13. An electrical receptacle connector, comprising:

a metallic shell comprising a shell body and a receptacle cavity formed in the shell body;

a first terminal module, received in the receptacle cavity of the metallic shell, wherein the first terminal module comprises a first insulated member and a plurality of first receptacle terminals, wherein the first insulated member comprises a first assembling portion and a plurality of observing windows, the first assembling portion is located at a bottom of a rear of the first insulated member, the first receptacle terminals are held in the first insulated member and comprise a plurality of first tail portions extending from the rear of the first insulated member and located on the first assembling portion, and the observing windows comprise recesses formed on the bottom of the rear of the first insulated member and near to two sides of the first tail portions, respectively; and a second terminal module, received in the receptacle cavity of the metallic shell and combined with the first terminal module, wherein the second terminal module comprises a second insulated member and a plurality of second receptacle terminals, wherein the second insulated member comprises a second assembling portion located at a bottom of a rear of the second insulated member and aligned in front of the first assembling portion, the second receptacle terminals are held in the second insulated member and comprise a plurality of second tail portions extending from the rear of the second insulated member and located on the second assembling portion, the second tail portions are aligned with the first tail portions by an offset, and positions of the second tail portions correspond to positions of the observing windows;

wherein a width of a hollowed region of each of the observing windows is greater than a width of each of the second tail portions.

14. The electrical receptacle connector according to claim 13, wherein the first tail portions and the second tail portions are SMT legs and the electrical receptacle connector is arranged to be assembled with a circuit board with the first tail portions and the second tail portions respectively in contact with a plurality of contacts of the circuit board.

15. The electrical receptacle connector according to claim 14, further comprising a first gap formed between the bottom of the rear of the first insulated member and a surface of the circuit board, wherein a height of the first gap is greater than a height from a bottom surface to a top surface of each of the first tail portions.

16. The electrical receptacle connector according to claim 14, further comprising a second gap formed between the bottom of the rear of the second insulated member and a surface of the circuit board, wherein a height of the second gap is greater than a height from a bottom surface to a top surface of each of the second tail portions.

17. The electrical receptacle connector according to claim 13, wherein the first terminal module further comprises a rear block extending outward from the rear of the first insulated member and covering the second tail portions, and wherein the first assembling portion is formed on a bottom of the rear block.

18. The electrical receptacle connector according to claim 13, wherein each of the second receptacle terminals comprises a second body portion and a second bending portion, the second body portion is held in the second insulated member, and each of the second bending portions is extending between the corresponding second body portion and the corresponding second tail portion.

19. The electrical receptacle connector according to claim 13, wherein the first receptacle terminals are at an upper surface of the second insulated member, and the second receptacle terminals are at a lower surface of the second insulated member, and wherein the first receptacle terminals and the second receptacle terminals have 180 degree symmetrical design with respect to a central point of the receptacle cavity as the symmetrical center.

20. The electrical receptacle connector according to claim 13, wherein the first terminal module and the second terminal module together constitute a one-piece member.

21. An electrical receptacle connector, comprising:

a metallic shell comprising a shell body and a receptacle cavity formed in the shell body;

a first terminal module, received in the receptacle cavity of the metallic shell, wherein the first terminal module comprises a first insulated member and a plurality of first receptacle terminals, wherein the first insulated member comprises a first assembling portion and a plurality of observing windows, the first assembling portion is located at a bottom of a rear of the first insulated member, the first receptacle terminals are held in the first insulated member and comprise a plurality of first tail portions extending from the rear of the first insulated member and located on the first assembling portion, and the observing windows comprise recesses formed on the bottom of the rear of the first insulated member and near to two sides of the first tail portions, respectively; and a second terminal module, received in the receptacle cavity of the metallic shell and combined with the first terminal module, wherein the second terminal module comprises a second insulated member and a plurality of second receptacle terminals, wherein the second insulated member comprises a second assembling portion located at a bottom of a rear of the second insulated member and aligned in front of the first assembling portion, the second receptacle terminals are held in the second insulated member and comprise a plurality of second tail portions extending from the rear of the second insulated member and located on the second assembling portion, the second tail portions are aligned with the first tail portions by an offset, and positions of the second tail portions correspond to positions of the observing windows;

wherein the first terminal module further comprises a through hole formed through a rear block and corresponding to the second tail portions.

22. The electrical receptacle connector according to claim 21, wherein the metallic shell comprises a rear cover plate extending from a rear of the shell body, wherein the rear cover plate comprises a baffle plate and a hole formed on a surface of the baffle plate for seeing, along with the through hole, the second tail portions.

23. The electrical receptacle connector according to claim 21, wherein the first tail portions and the second tail portions are SMT legs and the electrical receptacle connector is arranged to be assembled with a circuit board with the first tail portions and the second tail portions respectively in contact with a plurality of contacts of the circuit board.

* * * * *